US005083797A

United States Patent [19]

Vartija et al.

[11] Patent Number: 5,083,797

[45] Date of Patent: Jan. 28, 1992

[54] GAME BALL TRAINING APPARATUS/CARRIER

[76] Inventors: Scott O. Vartija, 1322 Cloverhill Rd., Mansfield, Tex. 76063; Peter B. Stewart, 3717 Stratford, Dallas, Tex. 75205

[21] Appl. No.: 644,071

[22] Filed: Jan. 18, 1991

[51] Int. Cl.[5] ..... A63B 69/00

[52] U.S. Cl. ..... 273/414; 273/58 C; 273/411; 403/211

[58] Field of Search ..... 273/414, 58 C, 411, 273/412, 413, 319, 320, 321, 329, 330, 331, 332, 333, 334, 335; 403/211

[56] References Cited

U.S. PATENT DOCUMENTS

| | | | |
|---|---|---|---|
| 672,099 | 4/1901 | Jackson | 273/58 C |
| 2,140,411 | 12/1938 | Wood | 273/413 |
| 2,269,633 | 1/1942 | Merle | 273/330 |
| 4,071,241 | 1/1978 | Cortes Garcia | 273/58 C |
| 4,095,787 | 6/1978 | Saferstein | 273/413 X |
| 4,147,353 | 4/1979 | Moore | 273/413 |
| 4,156,574 | 5/1975 | Boden | 403/211 |
| 4,247,117 | 1/1981 | Reichert | 273/411 |
| 4,278,257 | 7/1981 | Garcia et al. | 273/411 |
| 4,576,379 | 3/1986 | Juhasz | 273/411 |
| 4,601,474 | 7/1986 | Lew et al. | 273/414 |
| 4,687,209 | 8/1987 | Carey | 273/414 X |

FOREIGN PATENT DOCUMENTS

| | | | |
|---|---|---|---|
| 2105389 | 4/1972 | France | 273/411 |

*Primary Examiner*—William H. Grieb
*Attorney, Agent, or Firm*—David H. Judson

[57] ABSTRACT

A game ball assembly for use with a game ball is described comprising a net for receiving and holding the game ball, a handle adapted to be retained within a user's hand, a length adjuster having a body part and a relatively movable locking slide part defining with said body part two paths at opposite sides of the slide part, and an elongated substantially inelastic tether cord or rope secured between the handle and the net. The tether extends through one of the paths of the length adjuster, through the net and then through the other path of the length adjuster such that a free end of the tether is supported between the slide part and the body part of the length adjuster. This arrangement facilitates simple adjustment of the length of the tether.

11 Claims, 1 Drawing Sheet

FIG. 1
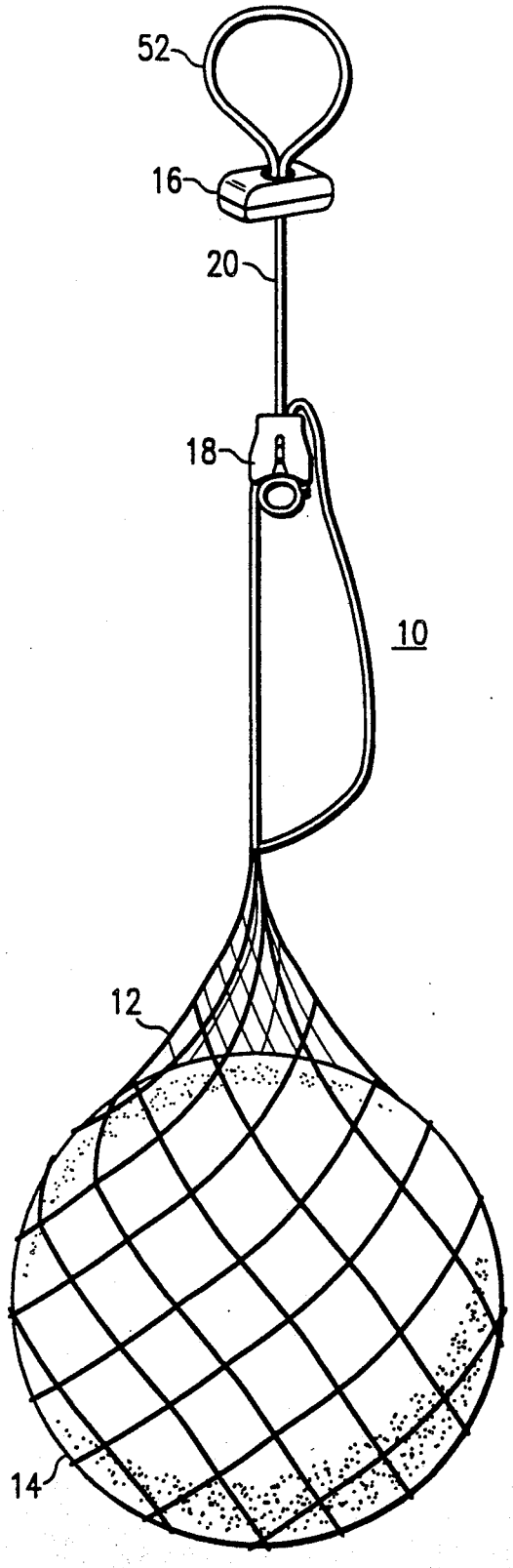
FIG. 2
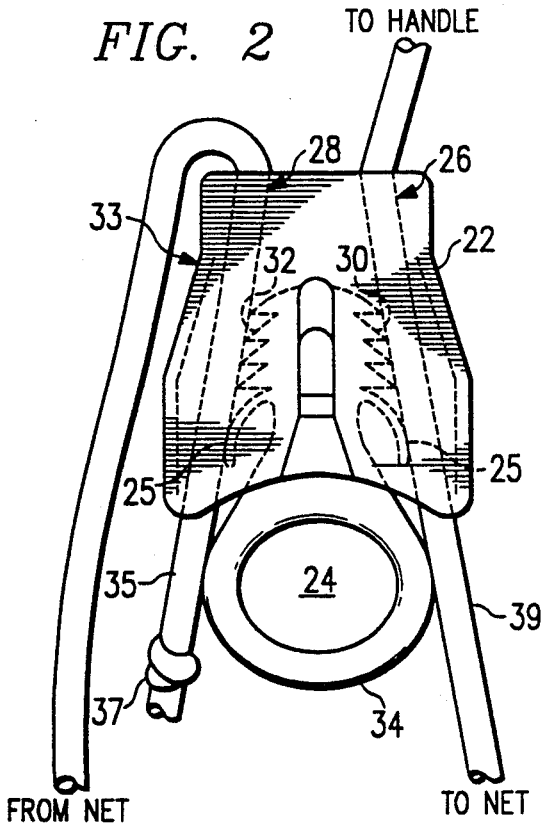
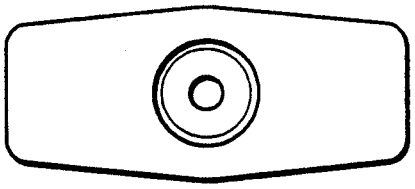
FIG. 3A
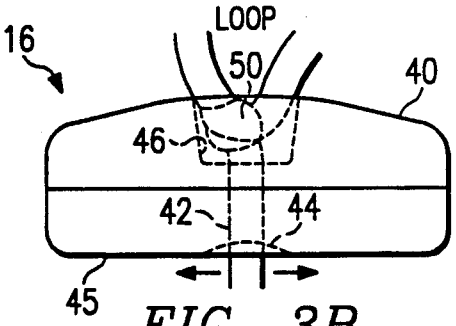
FIG. 3B
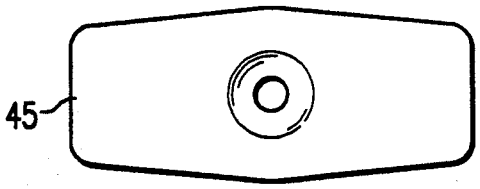
FIG. 3C

GAME BALL TRAINING APPARATUS/CARRIER

TECHNICAL FIELD

The present invention relates generally to training devices for children and more particularly to a combined game ball training device and carrier for soccer balls or the like primarily for use by children.

BACKGROUND OF THE INVENTION

Soccer has become one of the most popular sports in the United States among children of all ages. It is known in the prior art to provide soccer training assemblies to supplement Such devices generally include kickable balls attached to tether. One such device is shown in U.S. Pat. No. 4,687,209 to Carey which includes a captive soccer ball attached to a belt by a multicomponent tether. In another device, shown in U.S. Pat. No. 4,247,117 to Reichert, the tether is attached to a torso-mounted harness. U.S. Pat. No. 4,071,241 to Cortes Garcia disclosed yet another similar type of training device wherein an end of the tether cord is held by the user after the tether is passed through a waist belt. Other devices of this type are shown in U.S. Pat. Nos. 4,147,353, 4,278,257 and 4,576,379.

While the above-identified training devices are generally suitable for their intended purpose, they are often difficult to use by a young child. Such devices are often unnecessarily complex and thus expensive to manufacture and difficult to maintain. It would therefore be desirable to provide an improved training apparatus for use by children which overcomes these and other problems associated with the prior art.

BRIEF SUMMARY OF THE INVENTION

It is an object of the present invention to provide a combined soccer training device and carrier for a soccer ball for use by children.

It is yet another object of the present invention to provide a easy-to-use and durable training apparatus which includes an adjustable tether cord or rope.

It is a further object of the invention to provide a training device which is simple to manufacture, durable and inexpensive.

It is still another object of the invention to provide a soccer training device that allows a soccer player to practice, kicking, trapping, kneeing, throwing, dribbling, backheeling and head shots without having to retrieve the soccer ball.

It is another object to provide a training assembly that can be used indoors or outdoors that allows a novice to learn the basics of soccer as well as allowing a more advanced player to sharpen his or her skills.

These and other objects of the invention are provided in a game ball assembly for use with a game ball, comprising a net for receiving and holding the game ball, a handle adapted to be retained within a user's hand, a length adjuster having a body part and a relatively movable locking slide part defining with said body Part two paths at opposite sides of the slide part, and an elongated substantially inelastic tether cord or rope secured between the handle and the net. The tether extends through one of the paths of the length adjuster, through the net and then through the other path of the length adjuster such that a free end of the tether is supported between the slide part and the body part of the length adjuster. This arrangement facilitates simple adjustment of the length of the tether. To shorten the tether, the length adjuster is retained in the user s hand and the bottom part of the tether is pulled; to lengthen the tether, the length adjuster is simply held while the user pulls back on the handle. The length adjuster also serves to lock the tether against movement when the ball is kicked.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 1 is a perspective view of the combined game ball training device/carrier of the present invention;

FIG. 2 is a view of the preferred type of length adjuster for use with the present invention; and FIGS. 3A–3C are top, side and bottom views, respectively, of the preferred handle construction cf the assembly.

Similar reference characters refer to similar parts throughout the several views of the drawings.

DETAILED DESCRIPTION

The game ball assembly of the invention will be described below in connection with a soccer ball although other types of game balls such as footballs or the like can be used with the invention.

FIG. 1 is a perspective view of the combined game ball training device/carrier 10 of the present invention. The assembly includes a net 12 for receiving and holding the game ball 14, a handle 16 adapted to be retained within a user's hand, a length adjuster 18 and a tether cord or rope 20. The net is preferably formed of inelastic or other suitable non-stretchable material. The tether is preferably a braided or twisted nylon cord or rope or is formed of some other substantially inelastic material such as polypropylene. The use of a substantially inelastic material to form the tether is advantageous because it is long-lasting and can handle the stress of repeating stretching forces incurred during use of the invention. The use of inelastic material for the tether provides an extra degree of safety because the recoil force of an inelastic material is much lower than that of an elastic material, thus reducing the likelihood that the recoil force might injure the user.

Referring now simultaneously to FIG. 2, the length adjuster preferably includes a body part 22 and a relatively movable locking slide part 24 defining with said body part two paths 26 and 28 at opposite sides of the slide part. The slide part has two toothed opposite side faces 30 and 32 each having a number of teeth. The slide part of the adjuster has a handle portion 34 forming a handle loop accessible at the outside of the body part. A user can insert a finger through this loop and pull the slide element to move the slide from a locking position to an adjustment position. The slide part 24 also preferably includes two laterally projecting feeler arms 25 which are engageable laterally outward against the inner sides of the tether extending through the paths 26 and 28. Additional structural details of the adjuster are described in U.S. Pat. No. 4,156,574 to Boden, which is hereby incorporated by reference into this application.

The tether is secured between the handle and the net and is adjustable in length to facilitate use of the invention by children as well as more experienced, older players. As seen in FIG. 2, the tether extends through one of the paths (path 26) of the length adjuster, to and back from the net and then through the other path (path 28) of the length adjuster. The portion of the tether that returns from the net is brought alongside outer portion 33 of the body part and then extended back through the adjuster to enable the device to serve as an adjuster as well as a locking device. Outer portion 33 may include a tab or other structural element (not shown) for securing the tether against the body part. A free end 35 of the tether includes a knot 37 or other suitable retainer and is supported between the slide par& and the body part of the length adjuster. This arrangement facilitates simple adjustment of the length of the tether. To shorten the tether, the length adjuster is retained in the user's hand and the bottom part 39 of the tether is pulled; to lengthen the tether, the length adjuster is simply held while the user pulls back on the handle.

Once the tether is threaded through the length adjuster, as shown in FIG. 2, the slide part 24 need not be locked or unlocked in adjusting the tether length or otherwise during use. Length adjustments are made by merely holding the body part 22. The slide part 24 moves along automatically and then locks. The length adjuster thus serves to lock the tether against movement when the ball is kicked, dribbled, thrown, or otherwise manipulated. The length adjuster facilitates different types of exercises. Kicking exercises require a longer tether while the kneeing and other exercises are facilitated with a shorter tether.

Referring now to FIGS. 3A–3C, top, side and bottom views, respectively, of the preferred construction of the handle 16 are shown. The handle 16 is preferably formed of a molded, rigid plastic material. It includes an elongated body portion 40 having a passage 42 through which the tether is passed. A lower end of the passage 42 terminates in a small conical indentation 44 along the bottom surface 45 of the handle 16. An upper end of the passage 42 terminates in a large recess 46. As seen in FIG. 3B, the tether is movable within the indentation 44 in a lateral manner and thus is protected from damage as the assembly is used. The recess 46 provides space for a knot 50 such that as the handle is held in the palm of the user's hand, the knot does not rub against the palm. The looped portion 52 of the tether as best seen in FIG. 1 is then retained around the user's wrist. The looped portion 52 is advantageous for over the-head throwing exercises because, during such exercises, the user must open his or her hands and fully release the ball. The use of the looped portion insures that the user retains complete control of the assembly even if the handle is purposefully released (during such throwing exercises) or unintentionally released.

The soccer training device has numerous advantages. It allows a soccer player to practice kicking, trapping, kneeing, dribbling, throwing and head shots without having to retrieve the soccer ball. The assembly can be used indoors or outdoors and allows a novice to learn the basics of soccer or a more advanced player to sharpen his or her skills. The device allows the user to practice in a limited area and without assistance from others. After use, the netting itself safely transports the soccer ball and provides a convenient storage for the ball.

While the length adjuster has been specifically described, it should be appreciated that other suitable adjustment devices may also be used provided any such device allows for two cord paths and a movable slide such as disclosed above.

It also should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A game ball training device/carrier assembly for use with a game ball, comprising:

a net for receiving and holding the game ball;

a handle adapted to be retained within a user's hand;

a length adjuster having a body part with first and second ends, and a relatively movable locking slide part defining with said body part two paths at opposite sides of the slide part; and an elongated substantially inelastic tether in a predetermined threading configuration through the length adjuster, wherein a first end of the tether is attached to the handle and the tether is threaded through one of the paths of the length adjuster, through the net, and from the first end to the second end of the body part through the other path of the length adjuster such that a second wend of the tether is retained by the slide part adjacent the second end of the body part;

wherein said predetermined threading configuration enables the user to alter a spacing between the handle and the net by holding the length adjuster and pulling back on the handle.

2. The assembly as described in claim 1 wherein the tether is formed of braided or twisted nylon.

3. The assembly as described in claim 1 wherein the net is formed of an inelastic material.

4. The assembly as described in claim 1 wherein the handle includes a central aperture through which the tether is extended.

5. The assembly as described in claim 4 further including a recess in an upper portion of the handle for receiving a fastening knot of the tether.

6. The assembly as described in claim 1 wherein the game ball is a soccer ball.

7. The assembly as described in claim 1 wherein the game ball is a football.

8. The assembly as described in claim 1 wherein the tether further includes a looped portion adapted to fit around a user's wrist.

9. A training device/carrier assembly, comprising:

a game ball;

a net for receiving and holding the game ball;

a handle adapted to be retained within a user's hand;

a length adjuster having a body part with first and second ends, and a relatively movable locking slide part defining with said body part two paths at opposite sides of the slide part; and an elongated substantially inelastic tether in a predetermined threading configuration through the length adjuster, wherein a first end of the tether is attached to the handle and the tether is threaded through one of the paths of the length adjuster, through the net, and from the first end to the second end of the body part through the other path of the length adjuster such that a second end of the tether is retained by the slide part adjacent the second end of the body part;

wherein said predetermined threading configuration enables the user to alter a spacing between the handle and the net by holding the length adjuster and pulling back on the handle.

10. An assembly, comprising:

first and second retaining means;

a length adjuster having a body part with first and second ends, and a relatively movable locking slide part defining with said body part two paths at opposite sides of the slide part; and an elongated tether in a predetermined threading configuration through the length adjuster, wherein a first end of the tether is attached to the first retaining means and the tether is threaded through one of the paths of the length adjuster, through the second retaining means, and from the first end to the second end of the body part through the other path of the length adjuster such that a second end of the tether is retained by the slide part adjacent the second end of the body part;

wherein said predetermined threading configuration enables the user to alter a spacing between the first and second retaining means by holding the length adjuster and pulling back on the first retaining means.

11. The assembly as described in claim 10 wherein the first retaining means is a handle and the second retaining means is a net.

* * * * *